United States Patent [19]

Steiner

[11] 4,336,932

[45] Jun. 29, 1982

[54] EDGING FOR THE TRACK INSIDE OF A SPORTS INSTALLATION

[75] Inventor: Alfred Steiner, Andelfingen, Switzerland

[73] Assignee: Steiner Silidur A.G., Andelfingen, Switzerland

[21] Appl. No.: 226,673

[22] Filed: Jan. 19, 1981

[30] Foreign Application Priority Data

Jan. 22, 1980 [DE] Fed. Rep. of Germany ... 8001491[U]

[51] Int. Cl.[3] ..... A63K 1/00

[52] U.S. Cl. ..... 272/4; 52/102; 52/717; 404/7

[58] Field of Search ..... 272/4, 3, 5; 273/8, 273/9, 31; 52/102, 717, 718; 404/6, 7, 8, 15, 16

[56] References Cited

U.S. PATENT DOCUMENTS

| | | | |
|---|---|---|---|
| 2,000,466 | 5/1935 | Howard | 52/717 X |
| 3,222,838 | 12/1965 | Sweeney | 52/717 X |
| 3,737,972 | 6/1973 | Smoot | 52/717 X |
| 3,991,537 | 11/1976 | Brown | 52/717 |
| 4,176,982 | 12/1979 | Boswell | 272/3 X |

FOREIGN PATENT DOCUMENTS

| | | | |
|---|---|---|---|
| 1051472 | 3/1979 | Canada | 272/4 |
| 798619 | 3/1936 | France | 52/718 |
| 2266439 | 10/1975 | France | 52/718 |
| 1098028 | 1/1968 | United Kingdom | 52/718 |
| 1557180 | 12/1979 | United Kingdom | 272/4 |

*Primary Examiner*—Richard J. Apley
*Assistant Examiner*—Arnold W. Kramer
*Attorney, Agent, or Firm*—Benoit Law Corporation

[57] ABSTRACT

Edging for the track inside of a sports installation consists of a plurality of individual sections (1) abutting at their interfaces, each of which has an upper header body (2) of hard polyurethane synthetic material with a longitudinal slot 2*a*. Each section at its lower side is connected to at least two spacer pieces (3) of soft, resilient polyurethane synthetic material which rest on a foundation and are releasably connected thereto. Between the spacer pieces (3), passages 4 enable the drainage of water. Each spacer piece (3) has at its lower side an elongate inverted U-shaped carrier rail (5) inserted in countersunk manner and laterally enclosed by spacer piece (3). The hollow space (5*a*) has fastened thereto an inverted U-shaped spring clip (7), the legs of which resiliently reach under the head (8*a*) of an attachment screw (8) inserted in the foundation.

3 Claims, 2 Drawing Figures

EDGING FOR THE TRACK INSIDE OF A SPORTS INSTALLATION

The innovation concerns an edging for the track inside of a sports installation, which possesses an upper header body composed of a plurality of individual sections abutting at their interfaces, wherein each section at its lower side is connected to at least two spacer pieces which rest on a foundation and are releasably connected thereto.

An edging or border strip of this kind is already known from the German Utility Model No. 74 10 513.8 to the present inventor. Therein, the individual sections are made of galvanized rectangular tubular pieces, which laterally and on top are covered with a rubber layer vulcanized thereonto. Rectangular tube sections serve as spacer pieces and are partially open at the bottom. The spacer pieces reach under special carrier pieces which are bolted to the foundation. For a mounting and a disassembly of the edging, the individual sections have to be displaced in a longitudinal direction in order to put in the carrier pieces thereat and to release same therefrom, respectively.

There is also known an edging in which the individual sections are fastened by means of permanent magnets arranged at their undersides. The individual sections are very easily mounted and disassembled thereby; however, such a construction is expensive, since the procurement of permanent magnets is costly.

The innovation has the object of creating an edging of the initially mentioned type which may be manufactured substantially more cheaply and may be mounted and disassembled as simply as possible, as required by the instantaneous utilization of a sports installation.

The innovation is composed of the features of making the spacer pieces of an elastically resilient material, arranging at their lower side an elongate carrier rail, inverted U-shaped in cross-section and open at its lower side, which is inserted in a countersunk manner and is at least laterally enclosed by the material of the spacer pieces, and in the hollow space of which an approximately inverted U-shaped spring clip is fastened, the legs of which resiliently reach under the head of an attachment screw or the like, inserted in a foundation. The individual sections thus feature a kind of snap-button fastener. They may in the simplest manner be pressed onto the heads of the fastening screws and again removed therefrom. Suitably, the sections are made of hard polyurethane synthetic material and the spacer pieces of soft resilient polyurethane synthetic material, whereby the desired elasticity of the edging is achieved.

Figure 1:
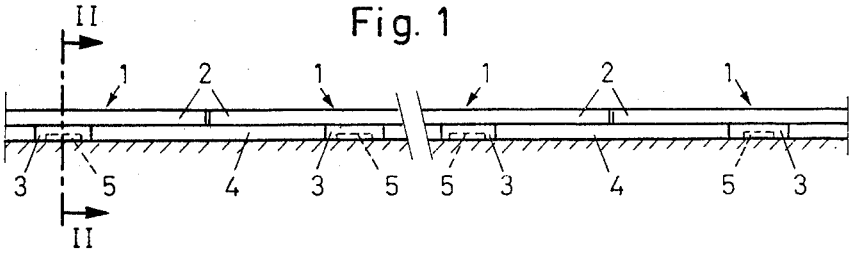
Figure 2:
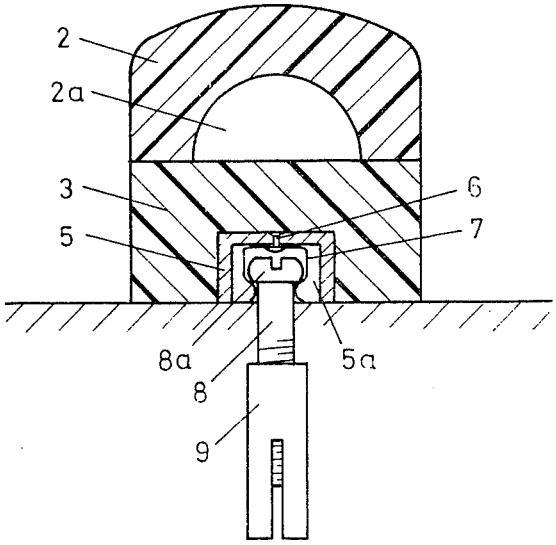

With the aid of an embodiment illustrated in the drawing, the edging or border strip according to the innovation is more particularly described as follows; there being shown in FIG. 1 a part of the edging in side view and FIG. 2 a section according to line II—II in FIG. 1 on a larger scale.

The edging or border strip is composed of a plurality of sections 1, of which each has an upper header body 2 of hard polyurethane synthetic material with a longitudinal slot 2*a*. At the lower side of the header bodies 2, spacer pieces 3 of soft, resilient polyurethane synthetic material are attached. Between the spacer pieces 3, passages 4 are present which enable the drainage of rain water. The spacer pieces rest on a foundation which, for example, may be made of concrete or synthetic material. Each spacer piece 3 further is releasably connected to the foundation. For this purpose, an elongate carrier rail 5, inverted U-shaped in cross-section and open at its lower side, is inserted in the lower side of each spacer piece 3 in a counter-sunk manner, so that it is laterally and on its top enclosed by the material of the spacer piece. A spring clip 7, which is also approximately inverted U-shaped, is fastened with a rivet 6 in the hollow space 5*a* of the carrier rail 5. That spring clip 7 reaches with its resilient legs under the head 8*a* of a screw 8 which is fastened with an anchor 9 in the foundation. The spring clip 7 forms, together with the correspondingly shaped head 8*a* of the screw 8, a snap-button fastener. After a one-time adjustment of the altitude level of the head 8*a*, the individual sections 1 of the edging may, therefore, be pressed onto the screws 8 from above and may also be lifted off again.

I claim:

1. Edging for the track inside of a sports installation, which possesses an upper header body (2) composed of a plurality of individual sections (1) abutting at their interfaces, wherein each section at its lower side is connected to at least two spacer pieces (3) which rest on a foundation and are releasably connected thereto, characterized in that the spacer pieces (3) are made of an elastically resilient material, and that at their lower side an elongate carrier rail (5), inverted U-shaped in cross-section and open at its lower side, is inserted in a countersunk manner and is at least laterally enclosed by the material of the spacer pieces (3), and in the hollow space (5*a*) of which an approximately inverted U-shaped spring clip (7) is fastened, the legs of which resiliently reach under the head (8*a*) of an attachment screw (8) or the like, inserted in a foundation.

2. Edging according to claim 1, characterized in that the sections (1) are made of hard synthetic material and the spacer pieces (3) of soft resilient synthetic material, e.g. of polyurethane.

3. Edging according to claim 1, characterized in that the sections (1) have an approximately semi-circular longitudinal slot (2*a*) at their lower side.

* * * * *